US007121566B2

(12) United States Patent
McClain

(10) Patent No.: US 7,121,566 B2
(45) Date of Patent: Oct. 17, 2006

(54) SKATEBOARD SUSPENSION SYSTEM

(76) Inventor: Nathan Myles McClain, 106 Gallivan St., Greenville, SC (US) 29609

( * ) Notice: Subject to any disclaimer, the term of this patent is extended or adjusted under 35 U.S.C. 154(b) by 130 days.

(21) Appl. No.: 10/619,925

(22) Filed: Jul. 15, 2003

(65) Prior Publication Data

US 2005/0012290 A1 Jan. 20, 2005

(51) Int. Cl.
*A63C 17/02* (2006.01)

(52) U.S. Cl. ..... 280/87.042; 280/11.28

(58) Field of Classification Search ..... 280/87.042, 280/87.043, 11.19, 11.27, 11.28; 267/152, 267/153, 140
See application file for complete search history.

(56) References Cited

U.S. PATENT DOCUMENTS

| | | | | | |
|---|---|---|---|---|---|
| 2,027,254 | A | * | 1/1936 | Vogt | 280/87.042 |
| 2,330,147 | A | * | 9/1943 | Rodriguez | 280/87.041 |
| 3,331,612 | A | * | 7/1967 | Tietge | 280/11.28 |
| 3,955,808 | A | * | 5/1976 | Jorn et al. | 267/152 |
| 4,054,297 | A | * | 10/1977 | Solimine | 280/87.042 |
| 4,060,253 | A | * | 11/1977 | Oldendorf | 280/87.042 |
| 4,103,917 | A | * | 8/1978 | Widolf | 280/11.28 |
| 4,109,925 | A | * | 8/1978 | Williams et al. | 280/11.28 |
| 4,120,508 | A | * | 10/1978 | Brown et al. | 280/11.28 |
| 4,120,510 | A | * | 10/1978 | Hillard | 280/87.042 |
| 4,125,268 | A | * | 11/1978 | Varner et al. | 280/11.28 |
| 4,184,693 | A | | 1/1980 | Whitmarsh | |
| 4,245,848 | A | * | 1/1981 | Dudouyt | 280/11.28 |
| 4,251,087 | A | | 2/1981 | Hansen | |
| 4,374,548 | A | * | 2/1983 | Ueno et al. | 180/409 |
| 4,398,734 | A | * | 8/1983 | Barnard | 280/11.28 |
| 4,775,162 | A | * | 10/1988 | Chao | 280/87.041 |
| 4,807,896 | A | * | 2/1989 | Philippi | 280/243 |
| 4,930,794 | A | * | 6/1990 | Chan | 280/11.28 |
| 5,048,632 | A | * | 9/1991 | Battel | 180/181 |
| 5,052,702 | A | * | 10/1991 | Chan | 280/11.28 |
| 5,110,660 | A | * | 5/1992 | Wolf et al. | 428/178 |
| 5,263,725 | A | | 11/1993 | Gesmer et al. | |
| 5,522,620 | A | | 6/1996 | Pracas | |
| D404,784 | S | * | 1/1999 | Ramage | D21/771 |
| 5,971,411 | A | | 10/1999 | Jones et al. | |
| 5,997,018 | A | * | 12/1999 | Lee | 280/87.042 |
| 6,056,302 | A | | 5/2000 | Smith | |
| 6,224,076 | B1 | | 5/2001 | Kent | |
| 6,247,686 | B1 | * | 6/2001 | Gabbin | 267/147 |

(Continued)

OTHER PUBLICATIONS

International Search Report and Written Opinion for PCT US04/22637, Jun. 22, 2005.

*Primary Examiner*—Christopher P. Ellis
*Assistant Examiner*—Bridget Avery
(74) *Attorney, Agent, or Firm*—J. Bennett Mullinax, LLC

(57) ABSTRACT

A truck assembly for use on a skateboard. The truck assembly includes a housing that is configured for attachment to a board of the skateboard. The housing has a longitudinal axis. A resilient member may be retained by the housing. A mounting member may engage the resilient member and may be disposed in the direction of the longitudinal axis of the housing. An axle may be present and may be retained by the mounting member. The axle may be configured for receiving at least one wheel of the skateboard. A resilient member for use with a truck assembly is also provided. The resilient member may include a body portion that has a cavity from one end to an opposite end. The cavity may be configured for receiving a mounting member of a truck assembly, and may be configured to resist torsional forces applied by the mounting member.

41 Claims, 6 Drawing Sheets

U.S. PATENT DOCUMENTS 6,286,843 B1 * 9/2001 Lin ..... 280/11.28
6,299,186 B1 * 10/2001 Kao et al. ..... 280/87.041
6,315,312 B1 11/2001 Reyes et al.
6,367,819 B1 4/2002 Andersen et al.
6,520,517 B1 * 2/2003 Chung et al. ..... 280/87.042
6,547,262 B1 * 4/2003 Yamada et al. ..... 280/11.28
6,616,155 B1 * 9/2003 Tuan ..... 280/87.041
6,648,345 B1 * 11/2003 Lee ..... 280/11.27
6,669,215 B1 * 12/2003 Laporte ..... 280/87.042
6,761,369 B1 * 7/2004 Anderson ..... 280/87.042

* cited by examiner

SKATEBOARD SUSPENSION SYSTEM

TECHNICAL FIELD

The present invention relates generally to skateboards and suspension systems used for skateboards. More particularly, the present invention relates to a skateboard truck assembly and a resilient member that may be used in the truck assembly that provides for an improved suspension and steering mechanism.

BACKGROUND

Skateboarding is both a popular recreational activity and a serious, competitive sport. Skateboards may be ridden on various types of surfaces, for instance streets, ramps, indoor courses, and off-road surfaces may all be traversed by skateboards. The performance of skateboards in various circumstances may be dependent upon both the ability of the rider and also the quality and design of the skateboard employed.

Skateboards are typically made of three main components, those being a deck, truck assemblies, and wheels. Decks, which are sometimes known as boards, usually have a flat center portion that accommodates the feet of the rider. Decks are typically elongated such that they are longer in length from the front to the rear of the deck than in width from either side of the deck. The front and/or back of the deck may in some instances be upturned in relation to the center portion of the deck.

The wheels of the skateboard are attached to the deck via the truck assembly. The truck assembly is provided with an axle onto which a pair of wheels are rotatably mounted. The truck assembly and wheels are mounted onto the bottom of the skateboard towards the front portion. A similar truck assembly with wheels is likewise mounted to the bottom of the skateboard near the rear portion. The two truck assemblies may be either identical, or of different configurations according to commonly known designs.

During operation, the rider may position his or her feet at any location on the board in order to control the skateboard in response to the given situation. For instance, the rider may have one foot located at the upturned rear portion of the board while the other foot is at the upturned front portion of the board. In order to turn left to right, the rider may shift his or her weight such that the deck is tilted about a longitudinal axis. This tilting is accommodated by the truck assemblies which allow for the wheels to be pivoted in order to accommodate a left or right turn. The truck assemblies may be designed in order to allow for this tilting/turning and to help stabilize the skateboard by urging the board back to the normally untilted position. In addition to providing for a smooth and predictable steering system, the truck assemblies may also be a suspension system that is designed to absorb shock imparted on the skateboard and provide for a more comfortable and improved ride.

Standard truck assemblies employ a pin that is oriented substantially perpendicular to the bottom surface of the board. The pin may be incorporated into a housing of the truck assembly that is attached to the board, or alternatively the pin may be disposed through a hole in the board and mounted thereon. The housing of the truck assembly encircles this vertically mounted pin and is in contact with the board and/or the pin through a resilient member. This resilient member therefore allows the housing of the truck assembly to pivot with respect to the pin. The truck assembly may also have an additional arm or member extending therefrom into a bearing element that is disposed on or in the board. The arm member may also pivot with respect to this bearing element. As such, conventional truck assemblies have a housing that is configured for attachment to the board at two locations, both of these locations providing for a pivoting arrangement of the housing. The resilient member and bearing element may also impart shock-absorbing properties into the truck assembly in addition to providing for the pivoting action.

Other truck assemblies include a housing that has a resilient member disposed therein with an axle member attached to the housing through the use of a mounting member. The mounting member may be retained through a slotted opening in the housing in order to allow the axle member to move substantially vertically with respect to the board. The resilient member engages the axle member in order to absorb shock that is imparted onto the truck assembly through the wheels attached to the axle member. In this configuration, the mounting member does not engage the resilient member, and the mounting member is disposed on one side of the resilient member.

The present invention provides for an improved truck assembly for use on a skateboard in order to allow for a truck assembly that exhibits better turning properties and/or suspension properties than those previously used in the art.

SUMMARY

The present invention improves upon previous truck assemblies by providing for a truck assembly that has a mounting member with at least one flat surface that is disposed through a resilient member in the direction of a longitudinal axis of a housing of the truck assembly. Alternatively, the present invention also provides for an improved truck assembly that has a resilient member retained by a housing along with a mounting member that engages the resilient member and is disposed in the direction of a longitudinal axis of the housing.

Various features and advantages of the invention will be set forth in part in the following description, or may be obvious from the description, or may be learned from practice of the invention. The present invention provides for a skateboard assembly and for a truck assembly for use on a skateboard. The truck assembly includes a housing that is configured for attachment to a board of the skateboard. The housing has a longitudinal axis. A resilient member may be retained by the housing, and a mounting member may engage the resilient member. The mounting member may be disposed in the direction of the longitudinal axis of the housing. Additionally, an axle may be retained by the mounting member and be configured for receiving at least one wheel of the skateboard thereon.

In accordance with an alternative exemplary embodiment, the skateboard assembly as discussed above may be used where the mounting member has at least one flat surface. Additionally, wheels may be rotatably mounted on the mounting arm, and the housing may be attached to the board.

In accordance with an alternative exemplary embodiment of the present invention, the housing of the truck assembly may have a retaining member, and the resilient member may be retained by the retaining member. Further, the flat surface of the mounting member may engage the resilient member, and the mounting member may be disposed through the resilient member. The axle may be pivotable with respect to the housing, and the axle may have at least one mounting arm extending transverse to the longitudinal axis of the housing.

The present invention also includes an exemplary embodiment as described above where the housing includes a plate that is configured for attachment to the board of the skateboard. Further, a retaining member may be present that includes a pair of legs attached to the plate, and a cap attached to the ends of the pair of legs.

The present invention also provides for an exemplary embodiment of the truck assembly as described above where the resilient member may be made of urethane or rubber. The resilient member may have a durametor value between 50 Shore A and 60 Shore D.

The present invention also provides for an exemplary embodiment of the truck assembly where the resilient member may be made of one or more sections. For instance, the resilient member may be made of a single section, two sections, or four sections in accordance with certain exemplary embodiments of the present invention. Additionally, the resilient member may in one exemplary embodiment be made of four sections that are each generally cylindrically shaped and extend in the direction of the longitudinal axis of the housing.

Also provided for in accordance with the present invention is a resilient member that may be used with a truck assembly. The resilient member includes a body portion that has a cavity present from one end of the body portion to an opposite end of the body portion. The cavity may be configured for receiving a mounting member of a truck assembly. The cavity is also configured for resisting torsional forces applied by the mounting member.

In certain exemplary embodiments, the body portion of the resilient member may have a plurality of tendon cavities that surround the cavity present in the resilient member. The tendon cavities may be at least partially defined by a plurality of tendons located in the resilient member. Both the cavity and the tendon cavities may extend from one end of the body portion to an opposite end of the body portion in various exemplary embodiments. Further, an alternative exemplary embodiment exists where the cavity is generally square shaped and has a generally dovetail shape at each of the four corners of the square. Further, there may be eight tendons and eight tendon cavities located in the resilient member, and an insert may also be included and retained by the resilient member and located in the cavity. It is to be understood that the aforementioned configurations of the resilient member having the tendons, tendon cavities, and a cavity that is generally square shaped with generally dovetail shapes at each corner may be employed in accordance with previously described exemplary embodiments of the present invention such as, for instance, the truck assembly and skateboard assembly previously described.

DETAILED DESCRIPTION

Figure 2:
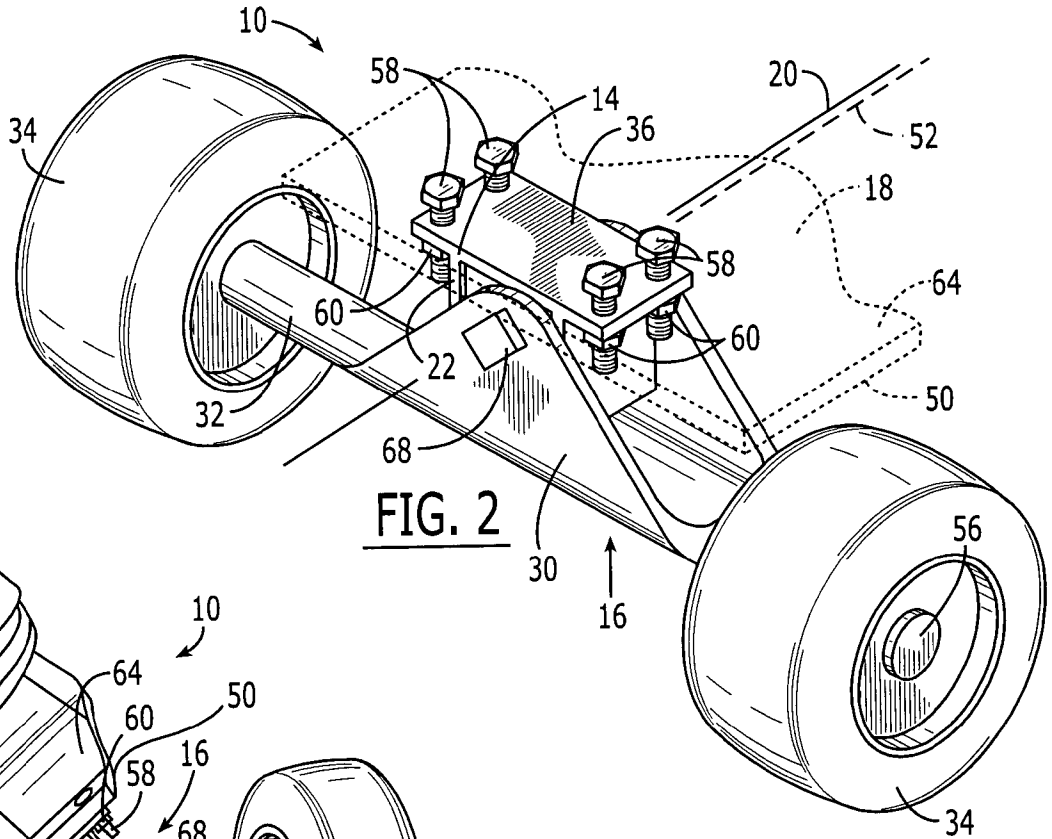
FIG. 2 is a perspective view of an exemplary embodiment of a truck assembly in accordance with one exemplary embodiment of the present invention. A pair of wheels and a board are shown attached to the truck assembly.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention provides for a truck assembly 16 that has a housing 14 with a longitudinal axis 20. A resilient member 24 (see FIG. 4) may be retained by the housing 14, and a mounting member 26 (see FIG. 3) may be disposed through the resilient member 24 in the direction of the longitudinal axis 20. By orienting the mounting member 26 in the direction of the longitudinal axis 20, the resulting truck assembly 16 exhibits better turning properties and/or suspension properties than truck assemblies previously used in the art.

Referring to FIG. 2, the figure shows a skateboard 10 that incorporates a preferred embodiment of the truck assembly 16 in accordance with the present invention. The skateboard 10 with the truck assembly 16 of FIG. 2 is shown in an exploded perspective view in FIG. 3. The truck assembly 16 includes a housing 14. The housing 14 may include a retaining member 22 that may made of a plate 36 in combination with a pair of legs 38. In the exemplary embodiment shown in FIG. 3, the legs 38 are parallel to one another, and extend from plate 36. Legs 38 are also perpendicular to plate 36. A cap 40 is present in the retaining member 22 and is attached to an end of both of the legs 38. The cap 40 is parallel to plate 36. Although this configuration of the housing 14 is the preferred embodiment, it is to be understood that other exemplary embodiments of the configuration of the housing 14 are possible.

Retaining member 22 may be provided in order to retain a resilient member 24. Resilient member 24 may be retained by a combination of legs 38 and cap 40 along with plate 36. Alternatively, the resilient member 24 may be retained by only the pair of legs 38 and/or the cap 40 in accordance with other exemplary embodiments of the present invention. In accordance with the preferred exemplary embodiment of the present invention, the resilient member 24 is retained by a combination of legs 38 and cap 40 along with the plate 36. As such, in the preferred exemplary embodiment of the present invention the retaining member 22 may be considered as including plate 36.

The resilient member 24 may be force fit into the retaining member 22 in order to be retained therein. However, it is to be understood that in other exemplary embodiments of the present invention, resilient member 24 may be retained on retaining member 22 of housing 14 by a variety of means commonly known in the art. For instance, adhesion, bolts, mechanical fasteners, or sonic welding may be employed in order to retain resilient member 24 on or in retaining member 22 of housing 14.

Resilient member 24 may include a cavity 44. Cavity 44 may be aligned with a pair of openings 66 that are present in an axle 30 of the truck assembly 16. Also, cavity 44 may be opened on one or both sides such that cavity 44 may or may not extend through resilient member 24. Cavity 44 may have a variety of cross sectional shapes and may extend in the direction of the longitudinal axis 20 in accordance with various exemplary embodiments of the present invention. Axle 30 may include one or more mounting arms 32 that extend in a direction transverse to the longitudinal axis 20.

Mounting member 26 is also included in the truck assembly 16. Mounting member 26 may have at least one flat surface 28 located thereon. In accordance with the preferred embodiment of the present invention, mounting member 26 includes four flat surfaces 28, and is therefore generally in the shape of a square pin. Mounting member 26 may be disposed through the pair of openings 66 in axle 30, and through the cavity 44 of the resilient member 24. A mounting member bolt 68 and a mounting member washer 70 may also be included and may engage the mounting member 26 in order to securely retain mounting member 26 onto axle member 30. Mounting member 26 may be provided with an internal cavity that has internal threading therein which mates with external threading on mounting member bolt 68. However, it is to be understood that various forms of attachment may be employed in order to secure mounting member 26 onto axle 30. For example, mounting member 26 may be welded onto axle 30 in accordance with another exemplary embodiment of the present invention. Alternatively, mounting member 26 and axle 30 may be formed as one piece.

Mounting member 26 may be disposed through resilient member 24 in accordance with certain exemplary embodiments of the present invention. Mounting member 26 may therefore be configured such that mounting member 26 is twisted or turned in resilient member 24. Mounting member 26 may also engage resilient member 24 and be disposed in the direction of the longitudinal axis 20 of housing 14 in accordance with other exemplary embodiments of the present invention.

Figure 3:
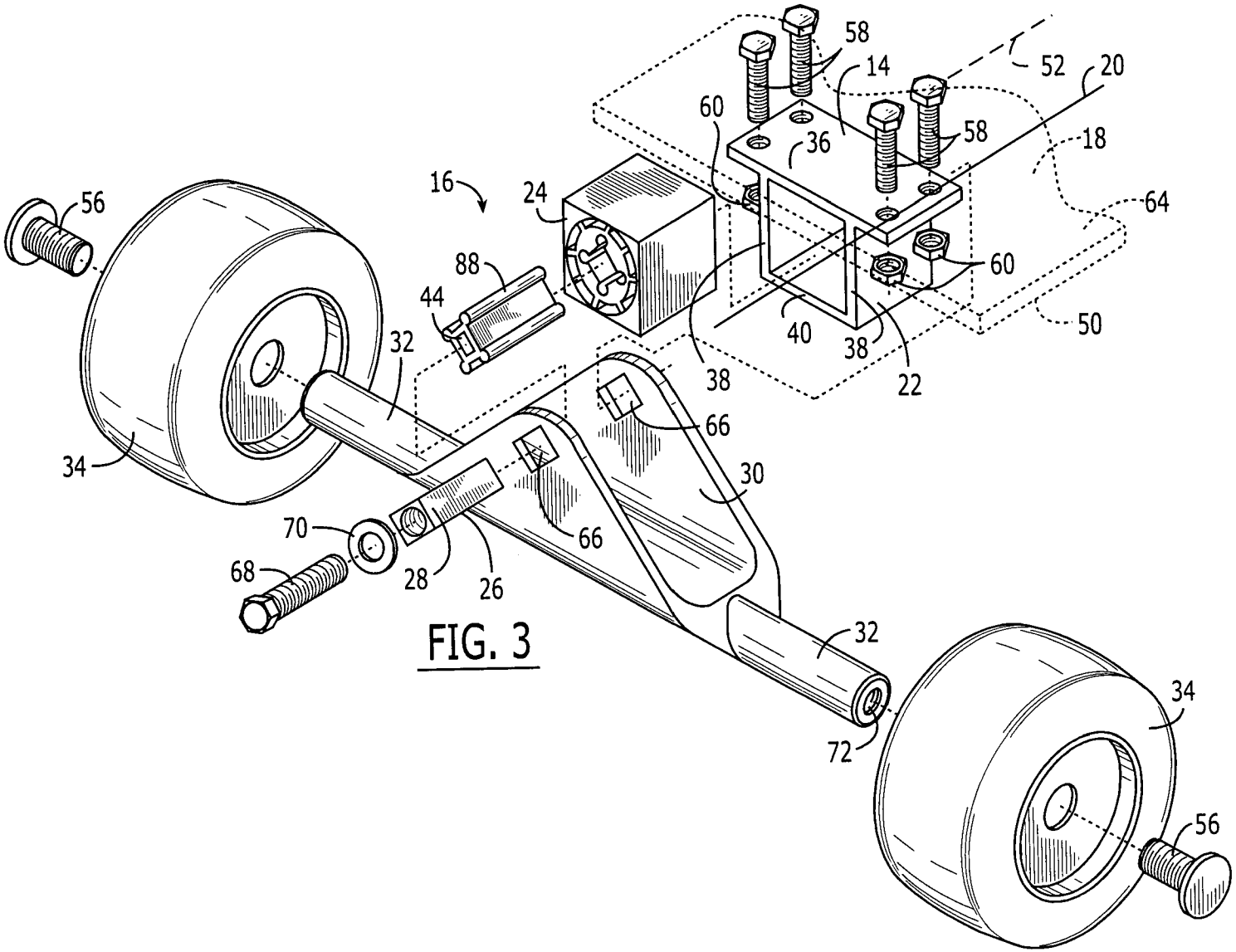
FIG. 3 is an exploded perspective view of the exemplary embodiment of the truck assembly shown in FIG. 2.

Mounting arm axle 32 may be a single piece, or may be made of multiple components. A pair of wheels 34 may be rotatably mounted onto mounting arm 32 in any manner commonly known in the art. As shown in FIGS. 2 and 3, a wheel bolt 56 may be used to retain wheel 34 onto mounting arm 32. Wheel bolt 56 may have external threading located thereon that engages internal threading within an axle bore 72 of mounting arm 32. Wheel 34 may be of any type commonly known in the art. Additionally, the rotatable attachment between the wheel 34 and mounting arm 32 of axle 30 may be made in any manner known to those skilled in the art.

Truck assembly 16 may be attached to a bottom surface 50 of board 18. The attachment of truck assembly 16 to board 18 may be made in any suitable manner known in the art. FIGS. 2 and 3 show one such attachment. Plate 36 of housing 14 may be provided with one or more holes in order to receive one or more housing bolts 58 in order to mechanically fasten plate 36 to board 18. FIGS. 2 and 3 show an exemplary embodiment of the present invention where plate 36 is provided with four holes through which four housing bolts 58 are disposed. Additionally, four housing nuts 60 are used in conjunction with four housing bolts 58 in order to securely fasten plate 36 onto board 18. Although shown as using four housing bolts 58, it is to be understood that in other exemplary embodiments of the present invention, any number of housing bolts 58 may be used in order to effect attachment between plate 36 and board 18. Additionally, other means of fastening plate 36 onto board 18 may also be employed in this or other exemplary embodiments of the present invention. For instance, plate 36 may be welded onto the bottom surface 50 of board 18. Alternatively, housing 14 may be integrally formed with board 18 in other exemplary embodiments of the present invention. As such, the present invention is not limited to a particular type of attachment between housing 14 and board 18.

As shown in FIGS. 2 and 3, mounting member 26 includes at least one flat surface 28. As stated, mounting member 26 is disposed through cavity 44 of resilient member 24. Resilient member 24 may be made of any material known in the art. For instance, in the preferred embodiment of the present invention the resilient member 24 is made of urethane. In accordance with another exemplary embodiment of the present invention, resilient member 24 may be made of rubber, or alternatively could be made of any form of PVC material. Additionally, resilient member 24 may be provided with different degrees of hardness and flexibility in accordance with different exemplary embodiments of the present invention. In accordance with one exemplary embodiment of the present invention, resilient member 24 may have a durometer value between 50 Shore A and 60

Shore D. Resilient member 24 may be made of the same material throughout, or be made of multiple materials that are incorporated therein.

Figure 9:
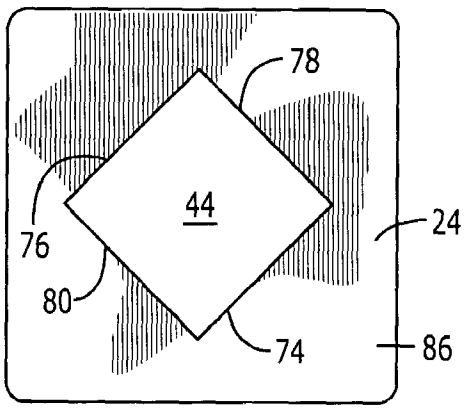
FIG. 9 is a front elevation view of a resilient member in accordance with one exemplary embodiment of the present invention. The resilient member is composed of one section and has a cavity with a generally square shaped cross section.

Resilient member 24 may be made of a single piece, or may be formed from multiple sections. FIG. 9 shows one exemplary embodiment of the present invention where resilient member 24 is a single piece, and has a cavity 44 with a cross sectional shape in the shape of a square. Although not shown in FIG. 9, mounting member 26 may be disposed through cavity 44 and may contact a first and second surface 74 and 76, respectfully, of resilient member 24. Twisting of mounting member 26 may cause mounting member 26 to be urged against the first and second surfaces 74 and 76. The resiliency of resilient member 24 may act to urge mounting member 26 back into its original position. Hence, resilient member 24 may act to resist rotation of the mounting member 26 within cavity 44. Additionally, resilient member 24 may be provided with a third and fourth surface, 78 and 80 respectively, which also engage mounting member 26. The third and fourth surface, 78 and 80 may also function in the same way as the first and second surfaces 74 and 76.

In accordance with one exemplary embodiment of the present invention, mounting member 26 may be a square pin that has four flat surfaces, each engaging one of the surfaces 74, 76, 78, and 80 of resilient member 24. In accordance with one exemplary embodiment of the present invention, it may be advantageous to have the mounting member 26 completely surrounded on all sides by resilient member 24. Such a configuration allows for shock absorption around the entire circumference or perimeter of mounting member 26. Additionally, such a configuration may allow for improved steering properties of skateboard 10 (FIG. 1) due to constant engagement of mounting member 26 and resistance to rotation of mounting member 26 by resilient member 24. However, it is to be understood that in other exemplary embodiments of the present invention that resilient member 24 need not be configured to completely surround mounting member 26. Additionally, it is to be understood that in other exemplary embodiments of the present invention that resilient member 24 need not be configured to constantly engage mounting member 26.

Figure 1:
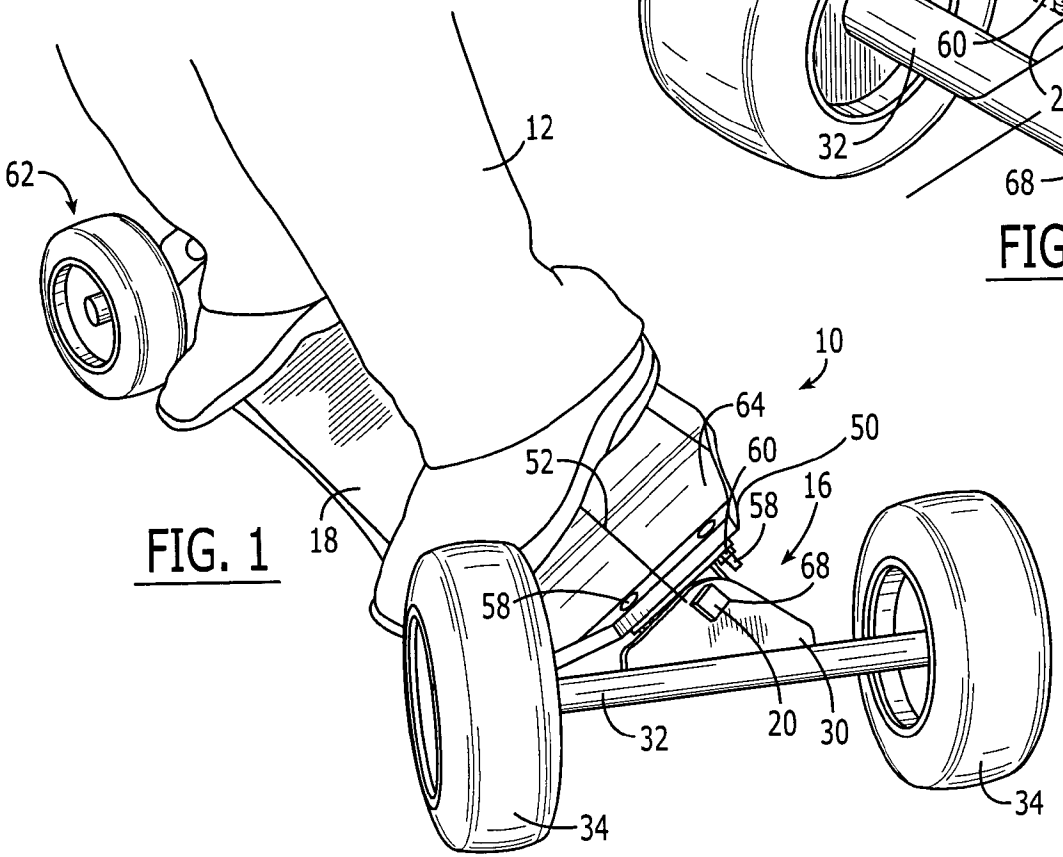
FIG. 1 is perspective view of an exemplary embodiment of a truck assembly on a skateboard in accordance with the present invention.
Figure 6:
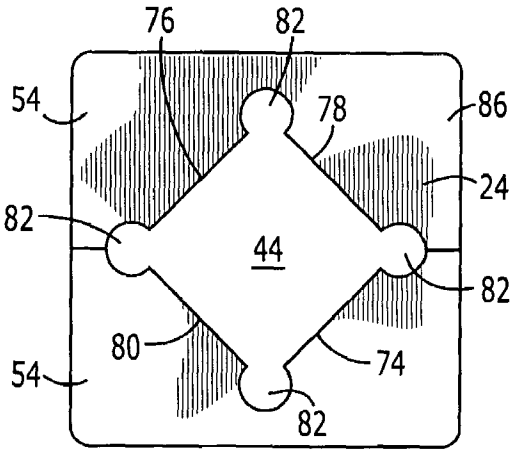
FIG. 6 is a front elevation view of a resilient member in accordance with one exemplary embodiment of the present invention. Here, the resilient member is composed of two sections and has a cavity that is generally square shaped with generally circular shaped portions at each of the four corners of the square.

FIG. 6 shows a configuration of resilient member 24 in accordance with another exemplary embodiment of the present invention. Here, resilient member 24 is again provided with a cavity 44 that has four surfaces 74, 76, 78 and 80. However, cavity 44 also has generally circular shaped portions 82 at the intersection of each two of the four surfaces 74, 76, 78, and 80. Although not shown in FIG. 6, mounting member 26 may be disposed through cavity 44 in much the same manner as previously described with respect to FIG. 9. However, the generally circular shaped portions 82 at the intersection of the four surfaces 74, 76, 78 and 80 provide for areas where mounting member 26 is not contacted by resilient member 24. Such a configuration may allow for better steering and/or suspension properties of skateboard 10 (FIG. 1). These improved steering and/or suspension properties may be realized through contact of resilient member 24 against only a portion of mounting member 26, and by allowing a space for the corners of the mounting member 26 to move upon being subjected to a twisting motion. This space is formed by the generally circular portions 82 of cavity 44 that are located at the intersection of the four surfaces 74, 76, 78, and 80.

Resilient member 24 shown in FIG. 6 is made of two sections 54. The two sections 54 may be attached to one another through any means commonly known in the art. For instance, adhesion, mechanical fasteners, or sonic welding may be employed in order to attach the two sections 54 of resilient member 24. Alternatively, the two sections 54 may remain separate pieces, and may each be carried and retained by retaining member 22 of housing 14 (FIGS. 2 and 3).

Figure 8:
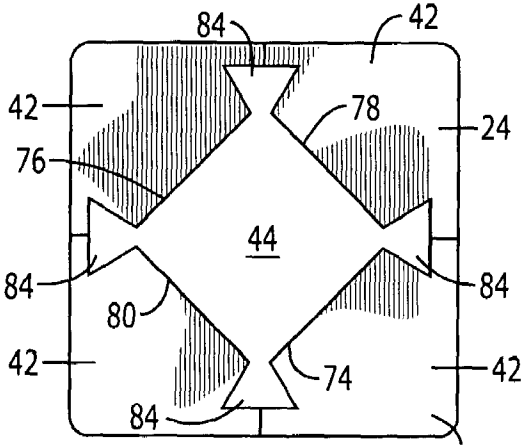
FIG. 8 is an elevation view of a resilient member in accordance with one exemplary embodiment of the present invention. Here, the resilient member is made of four sections and has a generally square shaped cavity with generally dovetail shaped portions at each of the four corners of the square.

FIG. 8 shows another exemplary embodiment of the present invention where resilient member 24 is formed from four sections 42. As with the exemplary embodiment of FIG. 6, the four sections 42 may be attached to one another or may be left as separate components in accordance with various exemplary embodiments of the present invention. Resilient member 24 is provided with four surfaces 74, 76, 78, and 80. Additionally, cavity 44 has generally dovetail shaped portions 84 at the intersection of each two of the four surfaces 74, 76, 78, and 80. The generally dovetail shaped portions 84 of cavity 44 may function in a manner substantially similar to the generally circular portions 82 of FIG. 6 as discussed above. Although shown as having a cavity 44 that is substantially symmetrical in cross section, it is to be understood that in other exemplary embodiments of the present invention cavity 44 of resilient member 24 may be of an irregular shape. The generally dovetail shaped portions 84 may also prevent slippage between the mounting member 26 and the resilient member 24.

The generally circular portions 82 shown in FIG. 6 and the generally dovetail shaped portions 84 shown in FIG. 8 may be present in order to relieve stress in resilient member 24 brought about by relative twisting between resilient member 24 and mounting member 26 (FIGS. 2 and 3). This stress relief may help to reduce tearing of resilient member 24.

Although described as being a square pin, mounting member 26 may be of various configurations in accordance with other exemplary embodiments of the present invention. For instance, mounting member 26 may have a circular cross section with one or more flat surfaces 28. Alternatively, mounting member 26 may have a cross sectional shape with a pair of flat surfaces 28 with a pair of curved surfaces therebetween. As such, mounting member 26 may be of any shape or configuration which will work according to teachings herein.

Figure 7:
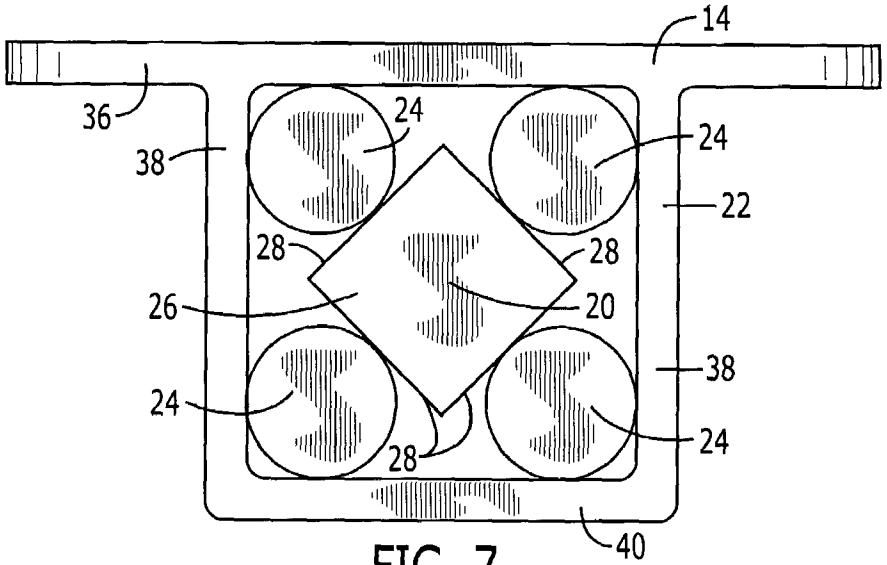
FIG. 7 is a front elevation view of a housing, mounting member, and resilient member in accordance with one exemplary embodiment of the present invention. Here, the mounting member is a square pin and the resilient member is made of four cylindrical shaped sections.

FIG. 7 shows an alternative exemplary embodiment of resilient member 24 in accordance with the present invention. Here, resilient member 24 is shown as being retained in retaining member 22 of housing 14. Housing 14 is also provided with plate 36 on one end thereof. The housing 14 shown in FIG. 7 is substantially similar to the housing 14 shown in previously described FIGS. 2 and 3.

Resilient member 24 may be made of four separate sections that are generally cylindrical in shape and extend in the direction of the longitudinal axis 20 of housing 14. Mounting member 26 may be a square pin that is disposed through resilient member 24 such that resilient member 24 is between mounting member 26 and legs 38 and cap 40 of retaining member 22. The four sections of resilient member 24 may be attached to retaining member 22 and/or mounting member 26 in accordance with one exemplary embodiment of the present invention. Alternatively, the four sections of resilient member 24 may simply be force fit into retaining member 22 and retained therein through the combination of mounting member 26, legs 30, and cap 40. The configuration of resilient member 24, retaining member 22, and mounting member 26 in FIG. 7 may also act to resist rotational movement of mounting member 26. Additionally, improved suspension properties of skateboard 10 (FIG. 1) may be realized through the arrangement in FIG. 7 where mounting member 26 is surrounded on various sides by resilient member 24.

Figure 10:
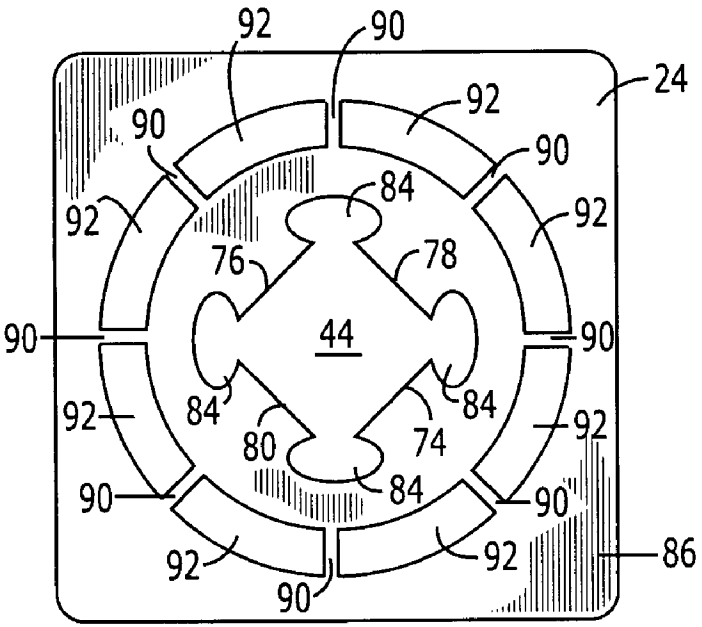
FIG. 10 is a front elevation view of a resilient member in accordance with one exemplary embodiment of the present invention. The resilient member includes a generally square shaped cavity surrounded by a plurality of tendon cavities defined, at least in part, by a plurality of tendons.

A preferred exemplary embodiment of resilient member 24 is shown in FIG. 10. Here, resilient member 24 includes a body portion 86 with a generally square shaped cavity 44 located therethrough. Four surfaces 74, 76, 78, and 80 are present as is the case in previously described exemplary embodiments, for instance the ones shown in FIGS. 6 and 8. Cavity 44 also includes generally dovetail shaped portions 84 located at each of the corners of cavity 44. However, as opposed to the generally dovetail shaped portions 84 in FIG. 8, the generally dovetail shaped portions 84 in FIG. 10 are slightly curved.

Figure 11:
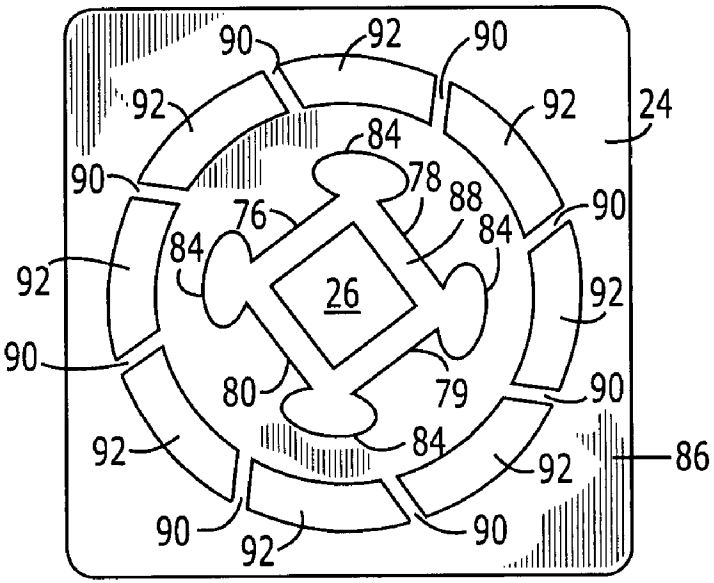
FIG. 11 is the resilient member of FIG. 10 with the addition of an insert located within the cavity of the resilient member, and shows torsional forces imparted on the resilient member.

The body portion 86 includes a plurality of tendons 90 that connect an outer section of the body portion 86 to an inner section of the body portion 86. As shown in FIG. 10, eight tendons 90 are present. Tendons 90 help define a plurality of tendon cavities 92 disposed through the body portion 86. In one exemplary embodiment of the present invention eight tendons 90 and eight tendon cavities 92 are present. The tendons 90 and the tendon cavities 92 may surround cavity 44. The plurality of tendon cavities 92 may roughly form a circumferential circle around cavity 44, with tendons 90 disposed therein. Torsional forces imparted onto the resilient member 24 at one or more of the four surfaces 74, 76, 78, and 80 may cause the tendons 90 to be deformed in a direction along the circle created by the tendon cavities 92. FIG. 11 shows such a deformation of the tendons 90 when torsional forces are applied to the four surfaces 74, 76, 78, and 80. The tendons 90 act to resist torsional forces applied by the mounting member 24 (FIG. 3).

FIG. 11 shows an insert 88 retained within the cavity 44 (FIG. 10). The insert 88 is also shown in FIG. 3, and has four generally dovetail shaped portions that engage the four generally dovetail shaped portions 84 of resilient member 24. Insert 88 also has a cavity with a square cross section that receives mounting member 26 which has a corresponding square cross section. The insert 88 may be used in order to more easily manufacture a shape that is received by the generally dovetail shaped portions 84 of the resilient member 24. However, it is to be understood in other exemplary embodiments of the present invention, that the mounting member 26 may itself be manufactured with portions that engage generally dovetail shaped portions 84.

Tendons 90 may be made of the same material as the rest of the resilient member 24, or may be made of a different material. Additionally, body portion 86 may be made from a single piece, or may be multiple pieces attached together in accordance with other exemplary embodiments of the present invention.

Figure 12:
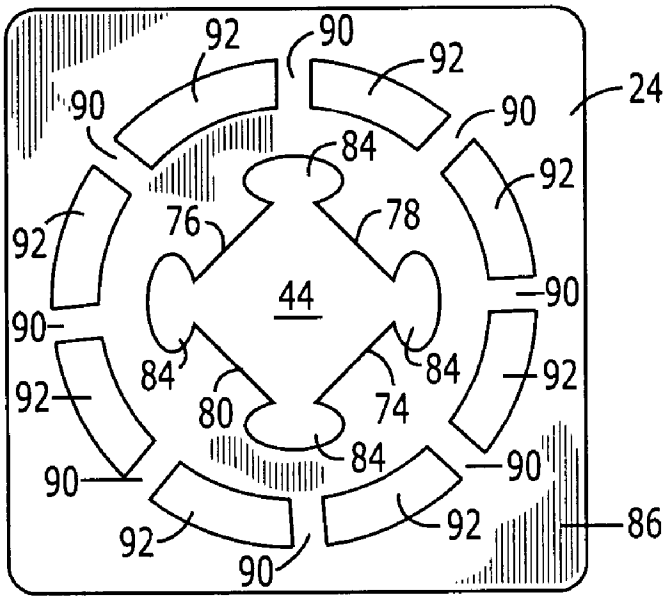
FIG. 12 is a front elevation view of a resilient member in accordance with one exemplary embodiment of the present invention. The resilient member is substantially similar to the one described in FIG. 10, with the exception of having tendons that are wider than those of FIG. 10.

FIG. 12 shows an exemplary embodiment of resilient member 24 where the tendons 90 are wider than the tendons 90 shown in FIGS. 10 and 11. Increasing the width of the tendons 90 increases their resistance to torsional forces. Therefore, the resilient member 24 may be made more resistant to torsional forces through an increase in the width of the tendons 90. Alternatively or additionally, the number of tendons 90 may be increased in order to increase the torsional resistance of the resilient member 24. As can be imagined, the width and/or number of tendons 90 may also be decreased in order to provide resilient member 24 with the desired resistance to torsional forces.

Figure 4:
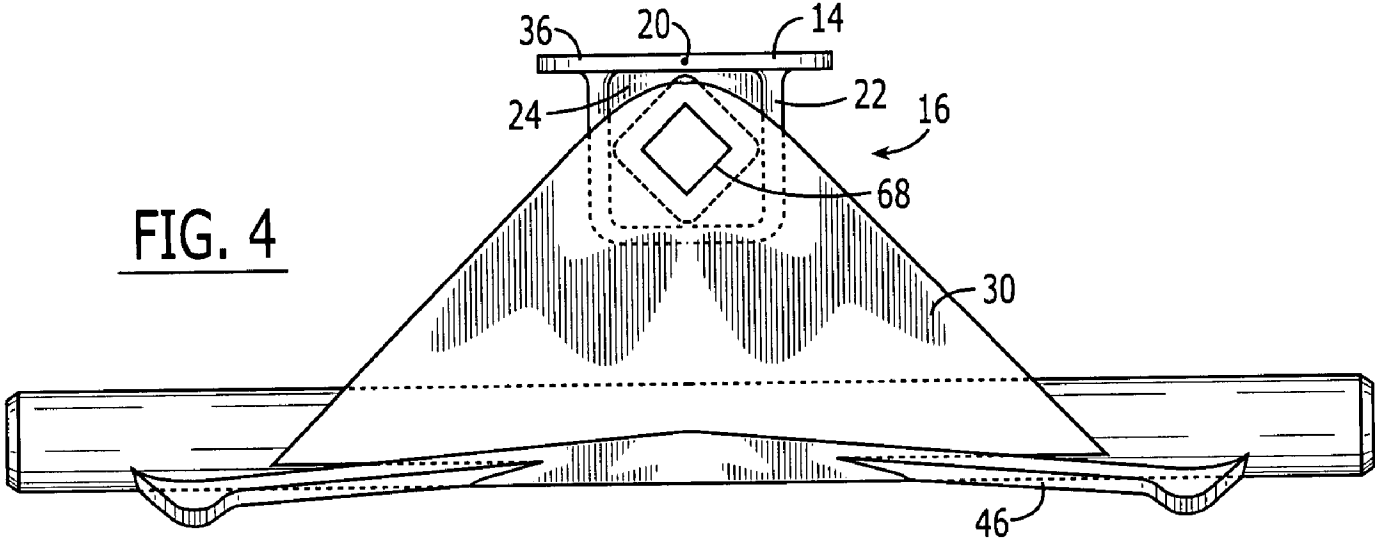
FIG. 4 is a front elevation view of an exemplary embodiment of a truck assembly in accordance with the present invention. Here, the truck assembly includes a housing that has a generally square retaining member.

FIG. 4 shows an alternative arrangement of truck assembly 16 in accordance with one exemplary embodiment of the present invention. Here, axle 30 is shown as being pivotably attached to housing 14 by way of resilient member 24 in a manner similar to that previously described. Mounting arm 32 of axle 30 is a single piece that extends in a direction transverse to the longitudinal axis 20 of housing 14. An axle 30 may also be provided with a grinding surface 46. Grinding surface 46 may be used in performing various maneuvers commonly known in the sport of skateboarding as "grinding". Such maneuvers could be, for instance, when skateboard 10 (FIG. 1) is "dumped" onto a surface such as the railing on a set of steps and slid thereon. The grinding surface 46 on axle 30 may provide for better handling properties of skateboard 10 (FIG. 1) upon performing these and other maneuvers.

Figure 5:
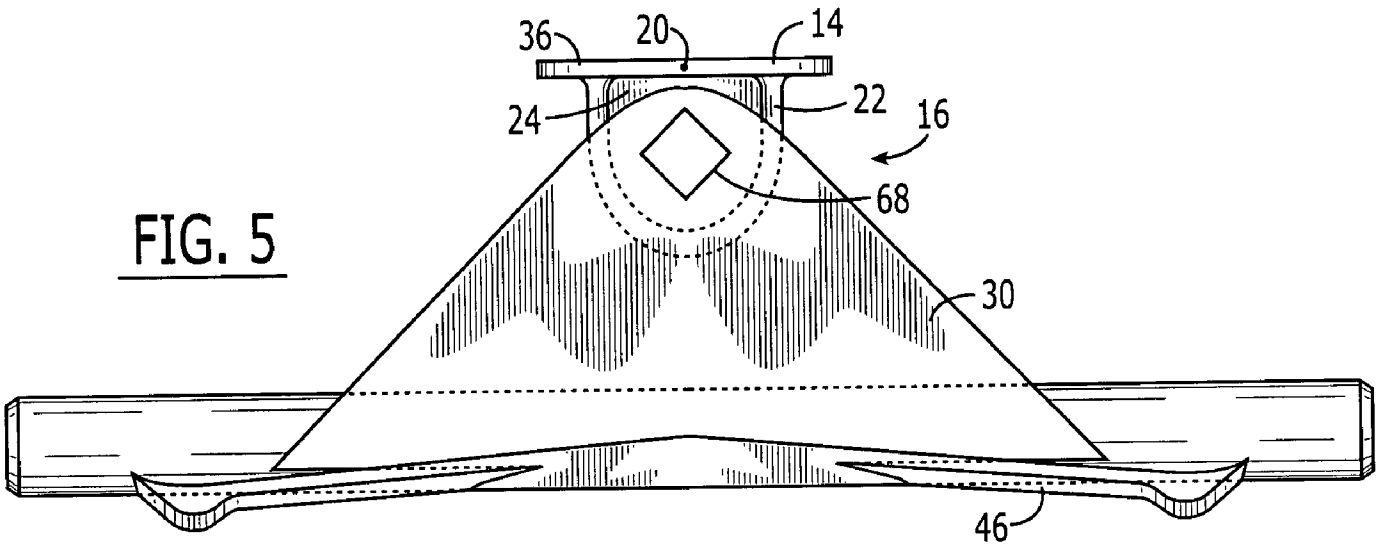
FIG. 5 is a front elevation view of an exemplary embodiment of a truck assembly in accordance with the present invention. Here, the truck assembly includes a retaining member that has a generally semi-circular cross section.

Although previously described as being generally square shaped, retaining member 22 of housing 14 may be of other shapes and configurations in accordance with other exemplary embodiments of the present invention. FIG. 5 shows one such embodiment where retaining member 22 of housing 14 has a semi circular shape on one end. Although not shown in FIG. 5, resilient member 24 may also have a semi circular shape on one end thereof in order to conform with the shape of retaining member 22. It is to be understood that the elements of the present invention may be composed of various materials and may be configured in various shapes with various forms of attachment to one another as is known to those skilled in the art.

Axle member 30 shown in FIG. 5 also has a grinding surface 46 located thereon. Although shown as the same in FIG. 4, it is to be understood that grinding surface 46 may be of various configurations in accordance with other exemplary embodiments of the present invention.

Figure 13:
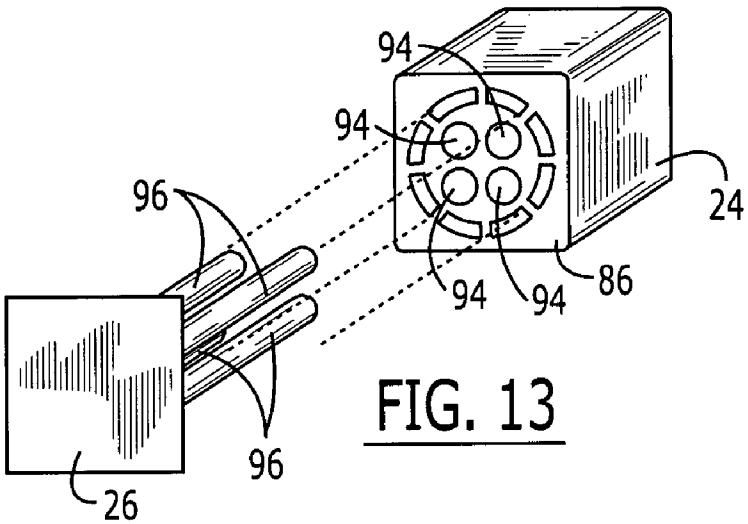
FIG. 13 is a perspective view of a resilient member and a mounting member in accordance with an exemplary embodiment of the present invention. Cylindrical pins on the mounting member engage corresponding pin cavities in the resilient member.

In certain exemplary embodiments of the present invention, the mounting member 26 has been described as having flat surface 28, for example those exemplary embodiments described with respect to FIGS. 3 and 7. FIG. 13 shows an exemplary embodiment of the present invention where the mounting member 26 does not include flat surface 28. Here, mounting member 26 is provided with four cylindrical pins 96 extending therefrom. The resilient member 24 is provided with four corresponding pin cavities 94 disposed therethrough. Cylindrical pins 96 may engage the pin cavities 94 and be retained therein. Rotation of the mounting member 26 will be resisted by resilient member 24 through the arrangement of the pin cavities 94 and cylindrical pins 96.

FIG. 1 shows the skateboard 10 incorporating truck assembly 16 of the present invention. Here, mounting arm axle 32 is a single piece and has a pair of wheels 34 rotatably mounted thereon. As shown, a rider 12 of skateboard 10 may pivot board 18 of skateboard 10 with respect to the longitudinal axis 52 of board 18. The longitudinal axis 52 extends along the longer length of board 18, as opposed to the narrower width of board 18. This pivoting action causes a corresponding pivoting of resilient member 24 (FIGS. 2 and 3) with respect to the longitudinal axis 20 of housing 14 (FIGS. 2 and 3). As discussed above with respect to FIGS. 6–9, relative rotational movement between mounting member 26 (FIGS. 2 and 3) and housing 14 (FIGS. 2 and 3) is counteracted by resilient member 24 (FIGS. 2 and 3). This counteracting may provide for improved steering properties of skateboard 10, along with the ability to help urge board 18 of skateboard 10 into a pre-tilt position.

Board 18 of FIG. 1 is provided with an inclined portion 64. Truck assembly 16 is attached to the bottom surface 50 of the inclined portion 64. This arrangement therefore rotates axle 30 of truck assembly 16 such that wheels 34 may be turned left or right depending upon the direction of rotation of board 18. In this manner, rider 12 may steer skateboard 10 upon tilting board 18 about the longitudinal axis 52.

Figure 14:
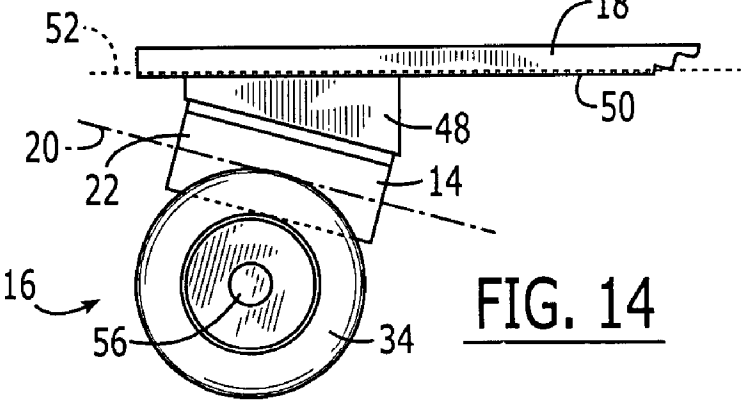
FIG. 14 is a side elevation view of a truck assembly in accordance with one exemplary embodiment of the present invention. Here, the truck assembly is attached to a wedge member that is attached to a board of the skateboard.

In other exemplary embodiments of the present invention, inclined portion 64 of board 18 need not be employed. For instance, FIG. 14 shows an exemplary embodiment where truck assembly 16 is not mounted to inclined portion 64 (FIG. 1). Here, a wedge member 48 is attached to the bottom surface 50 of board 18. Housing 14 of truck assembly 16 is attached to wedge member 48. Rotation of board 18 about the longitudinal axis 52 causes wheels 34 attached to truck assembly 16 to be turned in a left or right direction depending upon the direction of rotation of board 18. Wedge member 48 may be a separate piece or may be formed integrally with housing 14 or other components of the truck assembly 16. As used in the claims, it is to be understood that the phrase "in the direction of the longitudinal axis" includes configurations where the mounting member 26 is in a generally non-perpendicular direction to the longitudinal axis 20.

Referring to FIG. 1, truck assembly 16 of the present invention may be employed at either the front or back of board 18. Additionally, truck assembly 16 may be employed at both the front and back of board 18. As such, a back truck and wheel assembly 62 shown in FIG. 1 may be of the same configuration as truck assembly 16, or may be of a different configuration in accordance with those commonly known in the art.

The resilient member 24 may be configured in order to be able to provide any desired resistance to torsional forces to provide for an optimal ride of skateboard 10. The shape of resilient member 24 and/or the hardness of resilient member 24 may be varied in order to produce the desired resistance to torsional forces. As such, rider 12 may remove the resilient member 24 when rider 12 desires to change the handling properties of skateboard 10. Such a removal of the resilient member 24 may take place, for instance, when rider 12 wishes to go from using the skateboard 10 in an off-road application to an on-street application. In such an instance, rider 12 may insert a new resilient member 24 that exhibits the desired resistance for the new application in question. Additionally, rider 12 may place a new set of wheels 34 onto the skateboard 10 suited for the new application. As such, a plurality of different resilient members 24 may be sold or provided to rider 12 such that rider 12 may swap the resilient members 24 in and out of skateboard 10 to produce desired handling properties.

It should be understood that the present invention includes various modifications that can be made to the embodiments of the truck assembly 16 described herein as come within the scope of the appended claims and their equivalents.

I claim:

1. A skateboard assembly comprising:

a board;

a housing configured for attachment to the board, the housing having a longitudinal axis, the housing having a retaining member;

a resilient member retained by the retaining member of the housing;

a mounting member having at least one flat surface and disposed through the resilient member in the direction of the longitudinal axis of the housing, wherein the mounting member is disposed through the resilient member so as to extend from one end of the resilient member to an opposite end of the resilient member, at least one of the flat surfaces configured to be urged towards the resilient member during relative rotation between the flat surface of the mounting member and the resilient member;

an insert retained by the resilient member and having an aperture that is defined at least partially by a flat surface of said insert such that said flat surface of said insert contacts the flat surface of said mounting member;

an axle retained by the mounting member and pivotal with respect to the housing, the axle having at least one mounting arm extending transverse to the longitudinal axis of the housing; and a wheel rotatably mounted on the mounting arm.

2. The skateboard assembly of claim 1, wherein the housing comprising a plate configured for attachment to the board, and wherein the retaining member comprising a pair of legs attached to the plate and extending from the plate, and a cap attached to the ends of the pair of legs opposite from the plate.

3. The skateboard assembly of claim 1, wherein the resilient member is made of urethane.

4. The skateboard assembly of claim 1, wherein the mounting member is a square pin.

5. The skateboard assembly of claim 1, wherein the resilient member comprising four sections retained by the retaining member of the housing, the four sections disposed between the retaining member of the housing and the mounting member.

6. The skateboard assembly of claim 1, wherein the resilient member defines a cavity having open ends aligned in the direction of the longitudinal axis of the housing, the cross sectional shape of the cavity is generally square shaped having a generally circular shape at each of the four corners of the square, the mounting member disposed through the cavity.

7. The skateboard assembly of claim 1, wherein the axle has a grinding surface located thereon.

8. The skateboard assembly of claim 1, wherein the resilient member defines a cavity having open ends aligned in the direction of the longitudinal axis of the housing, the cross sectional shape of the cavity is square shaped with a pair of corners aligned transverse to the longitudinal axis of the housing, the mounting member disposed through the cavity.

9. The skateboard assembly of claim 1, wherein the resilient member defines a cavity having open ends aligned in the direction of the longitudinal axis of the housing, the cross sectional shape of the cavity is generally square shaped having a generally dovetail shape at each of the four corners of the square, the mounting member disposed through the cavity.

10. The skateboard assembly of claim 1, wherein the resilient member is made of rubber.

11. The skateboard assembly of claim 1, wherein the resilient member has a durometer value between 50 Shore A and 60 Shore D.

12. The skateboard assembly of claim 1, wherein the housing includes a wedge member configured to engage the bottom surface of the board of the skateboard.

13. The skateboard assembly of claim 1, wherein the resilient member has a cavity and a plurality of tendon cavities surrounding the cavity, the tendon cavities at least partially defined by a plurality of tendons located in the resilient member.

14. The skateboard assembly of claim 5, wherein the four sections of the resilient member are generally cylindrical shaped extending in the direction of the longitudinal axis of the housing.

15. The skateboard assembly of claim 13, wherein the cavity has a generally square shaped cross section and has a generally dovetail shape at each of the four corners of the square.

16. The skateboard assembly of claim 15, wherein the resilient member has eight tendons and eight tendon cavities.

17. A truck assembly for use on a skateboard, comprising:

a housing configured for attachment to a board of a skateboard, the housing having a longitudinal axis;

a resilient member retained by and in direct contact with the housing;

an insert retained by said resilient member and having an aperture that is defined at least partially by a flat surface of said insert;

a mounting member disposed in the direction of the longitudinal axis of the housing, wherein said mounting member has a flat surface that contacts the flat surface of said insert, and wherein the mounting member is disposed through the resilient member so as to extend from one end of the resilient member to an opposite end of the resilient member; and an axle retained by the mounting member and configured for receiving at least one wheel of the skateboard thereon.

18. The truck assembly of claim 17, wherein the housing comprising a plate configured for attachment to the board, and a retaining member being a pair of legs attached to the plate and extending from the plate, a cap attached to the ends of the legs opposite from the plate, the resilient member being retained in the retaining member.

19. The truck assembly of claim 17, wherein the resilient member is made of urethane.

20. The truck assembly of claim 17, wherein the mounting member is a square pin.

21. The truck assembly of claim 17, wherein the resilient member comprising four sections retained by the housing, the four sections disposed between the housing and the mounting member.

22. The truck assembly of claim 17, wherein the resilient member defines a cavity having open ends aligned in the direction of the longitudinal axis of the housing, the cross sectional shape of the cavity is generally square shaped having a generally circular shape at each of the four corners of the square, the mounting member disposed through the cavity.

23. The truck assembly of claim 17, wherein the resilient member defines a cavity having open ends aligned in the direction of the longitudinal axis of the housing, the cross sectional shape of the cavity is square shaped with a pair of corners aligned transverse to the longitudinal axis of the housing, the mounting member disposed through the cavity.

24. The truck assembly of claim 17, wherein the resilient member defines a cavity having open ends aligned in the direction of the longitudinal axis of the housing, the cross sectional shape of the cavity is generally square shaped having a generally dovetail shape at each of the four corners of the square, the mounting member disposed through the cavity.

25. The truck assembly of claim 17, wherein the resilient member is made of rubber.

26. The truck assembly of claim 17, wherein the resilient member has a durometer value between 50 Shore A and 60 Shore D.

27. The truck assembly of claim 17, wherein the housing includes a wedge member configured to engage the bottom surface of the board of the skateboard.

28. The truck assembly of claim 17, wherein the axle has a grinding surface located thereon.

29. The truck assembly of claim 17, wherein the resilient member has a cavity and has a plurality of tendon cavities surrounding the cavity, the tendon cavities at least partially defined by a plurality of tendons located in the body portion.

30. The truck assembly of claim 17, wherein: the mounting member has four cylindrical pins; and the resilient member has four pin cavities, each one of the four cylindrical pins of the mounting member disposed in a separate one of the four pin cavities.

31. The truck assembly of claim 21, wherein the four sections of the resilient member are generally cylindrical shaped extending in the direction of the longitudinal axis of the housing.

32. The truck assembly of claim 29, wherein the cavity is generally square shaped and has a generally dovetail shape at each of the four corners of the square.

33. The truck assembly of claim 32, wherein the resilient member has eight tendons and eight tendon cavities.

34. A truck assembly for use on a skateboard, comprising:

a housing having a longitudinal axis and a plate configured for attachment to a board of a skateboard, the housing having a retaining member comprising a pair of legs attached to the plate and extending from the plate and having a cap attached to the ends of the pair of legs opposite from the plate;

a resilient member retained by the retaining member of the housing and defining a cavity having open ends aligned in the direction of the longitudinal axis of the housing, the cross sectional shape of the cavity being generally square shaped having a generally circular shape at each of the four corners of the square, the resilient member made of urethane;

an insert retained in the cavity of the resilient member;

a mounting member being a square pin disposed through the cavity of the resilient member in the direction of the longitudinal axis of the housing, wherein the mounting member is disposed through the cavity so as to extend from one end of the resilient member to an opposite end of the resilient member, the mounting member engaging the insert, wherein said insert has an aperture that is defined at least partially by a flat surface of said insert such that said flat surface contacts a complimentary flat surface of said mounting member; and an axle retained by the mounting member and pivotal with respect to the housing, the axle having a mounting arm extending transverse to the longitudinal axis of the housing, the mounting arm configured for receiving a pair of wheels of the skateboard thereon.

35. A resilient member for use with a truck assembly, comprising:

a body portion having a cavity disposed from one end of the body portion to an opposite end of the body portion, the cavity configured for receiving a mounting member of the truck assembly, and the cavity configured for resisting torsional forces applied by the mounting member, and an insert retained by the body portion and located in the cavity and configured for receiving the mounting member, wherein said insert has an aperture that is defined at least partially by a flat surface of said insert such that said flat surface is configured for contacting a complimentary flat surface of the mounting member, and wherein said insert is disposed through the body portion so as to extend from one end of the body portion to an opposite end of the body portion.

36. The resilient member of claim 35, wherein the cross sectional shape of the cavity is generally square shaped.

37. The resilient member of claim 35, wherein the body portion is made of urethane.

38. The resilient member of claim 35, wherein the body portion has four cavities.

39. The resilient member of claim 36, wherein the body portion has a plurality of tendon cavities surrounding the cavity and extending from one end of the body portion to an opposite end of the body portion, the tendon cavities at least partially defined by a plurality of tendons located in the body portion.

40. The resilient member of claim 39, wherein the cavity has a generally dovetail shape at each of the four corners of the square.

41. The resilient member of claim 40, wherein the body portion has eight tendons and eight tendon cavities.

* * * * *